US007652641B2

(12) United States Patent
Chae et al.

(10) Patent No.: US 7,652,641 B2
(45) **Date of Patent: *Jan. 26, 2010**

(54) DRIVING APPARATUS OF PLASMA DISPLAY PANEL

(75) Inventors: Seung-Hun Chae, Suwon-si (KR); Woo-Joon Chung, Suwon-si (KR); Jin-Sung Kim, Suwon-si (KR); Kyoung-Ho Kang, Suwon-si (KR); Tae-Seong Kim, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 808 days.

This patent is subject to a terminal disclaimer.

(21) Appl. No.: 10/968,162

(22) Filed: Oct. 20, 2004

(65) Prior Publication Data

US 2005/0093781 A1 May 5, 2005

(30) Foreign Application Priority Data

Oct. 21, 2003 (KR) ..... 10-2003-0073534

(51) Int. Cl.
*G09G 3/28* (2006.01)

(52) U.S. Cl. ..... 345/66; 345/60; 345/69

(58) Field of Classification Search ..... 345/60, 345/66, 41, 42, 62, 69
See application file for complete search history.

(56) References Cited

U.S. PATENT DOCUMENTS

| | | | | |
|---|---|---|---|---|
| 4,384,287 | A * | 5/1983 | Sakuma | 345/60 |
| 5,745,086 | A | 4/1998 | Weber | |
| 6,483,250 | B1 * | 11/2002 | Hashimoto et al. | 315/169.4 |
| 6,906,690 | B2 * | 6/2005 | Lim | 345/60 |
| 2005/0083262 | A1 * | 4/2005 | Chae et al. | 345/60 |

* cited by examiner

*Primary Examiner*—Amare Mengistu
*Assistant Examiner*—Seokyun Moon
(74) *Attorney, Agent, or Firm*—H.C. Park & Associates, PLC

(57) ABSTRACT

A driving apparatus of a plasma display panel for applying a rising or falling waveform to a panel capacitor, comprising a transistor for forming a current path between a power source and the panel capacitor while the transistor is turned on, and which is coupled between the power source and one end of the panel capacitor. A first capacitor and a second capacitor are coupled in parallel to each other and in between a drain and a gate of the transistor. A first resistor and a first diode are coupled in parallel to each other between a first end of the first capacitor and the gate, and a second resistor and a second diode are coupled in parallel to each other between a first end of the second capacitor and the gate.

23 Claims, 10 Drawing Sheets

DRIVING APPARATUS OF PLASMA DISPLAY PANEL

CROSS REFERENCE TO RELATED APPLICATION

This application claims priority to and the benefit of Korean Patent Application No. 10-2003-0073534, filed on Oct. 21, 2003, which is hereby incorporated by reference for all purposes as if fully set forth herein.

BACKGROUND OF THE INVENTION

1. Field of the Invention

The present invention relates to a driving apparatus of a plasma display panel (PDP), and more specifically, to a driving circuit that applies a ramp waveform to an electrode of a PDP during a reset period.

2. Description of the Related Art

Flat display devices such as liquid crystal displays (LCDs), field emission displays (FEDs), and PDPs have been actively developed in recent years, but PDPs are brighter, they have better emission efficiency, and they have wider viewing angles. Therefore, PDPs are being considered as a primary substitute for the large-sized cathode ray tubes (CRTs) of over 40 inches.

A PDP displays characters or images using plasma generated by gas discharge, and several tens of thousands to several million pixels may be arranged in a matrix format on the PDP according to its size. The PDP is classified as a direct current (DC) PDP or an alternating current (AC) PDP depending on driving voltage waveforms and discharge cell structure.

Electrodes of a DC PDP are exposed to a discharge space, and current flows through the discharge space when a voltage is applied, which requires a resistor to restrict such current. However, a dielectric layer covers the electrodes of an AC PDP to naturally form a capacitance component which restricts the current. The dielectric layer also protects the electrodes of an AC PDP from ion impact at discharge. Thus, the AC PDP has a longer life than the DC PDP.

FIG. 1 is a partial perspective view of a conventional AC PDP.

As shown in FIG. 1, parallel pairs of a scan electrode 4 and a sustain electrode 5 are arranged on a first glass substrate 1, and are covered with a dielectric layer 2 and a protective layer 3. A plurality of address electrodes 8, which are covered with an insulating layer 7, is arranged on a second glass substrate 6. Barrier ribs 9 are formed on the insulating layer 7 in parallel to, and in between, the address electrodes 8. A fluorescent material 10 covers the surface of the insulating layer 7 and both sides of the barrier ribs 9. The first and the second glass substrates 1 and 6 are sealed together to form a discharge space 11 therebetween, so that the scan electrodes 4 and the sustain electrodes 5 are orthogonal to the address electrodes 8. A discharge space 11 at an intersection between an address electrode 8 and the pair of the scan electrode 4 and sustain electrode 5 forms a discharge cell 12.

FIG. 2 shows a typical electrode arrangement of a PDP.

As shown in FIG. 2, the PDP electrodes have an m×n matrix construction. In particular, address electrodes $A_1$ to $A_m$ are arranged in the column direction, and n rows of scan electrodes $Y_1$ to $Y_n$ (Y electrodes) and n rows of sustain electrodes $X_1$ to $X_n$ (X electrodes) are alternately arranged in the row direction. A discharge cell 12 shown in FIG. 2 corresponds to a discharge cell 12 shown in FIG. 1.

Generally, a conventional driving method of an AC PDP includes a reset period, an address period, and a sustain period with respect to temporal operation variations.

The reset period erases wall charges formed by a previous sustain discharge, and initializes the condition of each cell so as to stably perform a next address discharge. The address period selects cells that are to be turned on, and accumulates wall charges on the selected cells (addressed cells). The sustain period executes a discharge by alternately applying the sustain pulse to the scan electrode and the sustain electrode, which displays an image.

According to a conventional method, a ramp waveform may be applied to the scan electrode to establish a wall charge in the reset period, as disclosed in U.S. Pat. No. 5,745,086. Specifically, a gradually rising ramp waveform followed by a gradually falling ramp waveform may be applied to the scan electrode in the reset period.

FIGS. 3A and 3B show driving circuits for applying a conventional ramp waveform. FIG. 3A is a driving circuit for applying a rising ramp waveform, and FIG. 3B is a driving circuit for applying a falling ramp waveform.

As shown in FIG. 3A, a conventional rising ramp driving circuit includes a transistor $M_{11}$, a capacitor $C_{11}$, resistors $R_{11}$ and $R_{12}$, a diode $D_{11}$, and a power source for control signals $V_{g1}$; and resistors $R_{13}$ and $R_{14}$ connected between the power source for control signals $V_{g1}$ and the transistor $M_{11}$, and a diode $D_{12}$.

A drain of the transistor $M_{11}$ is connected to a power source $V_1$, and a source of the transistor $M_{11}$ is connected to the first end of a panel capacitor $C_p$. The power source for control signals $V_{g1}$ is connected between a gate and a ground end of the transistor $M_{11}$, and it supplies control signals to the transistor $M_{11}$. Further, the diode $D_{11}$ and the resistor $R_{11}$ are connected between the drain of the transistor $M_{11}$ and the capacitor $C_{11}$, and they form a path through which the capacitor $C_{11}$ is charged or discharged. Further, the panel capacitor $C_p$, the power source $V_{g1}$, and the capacitor $C_{11}$ all are connected to the power source $V_s$. The resistor $R_{13}$ forms a path for charging the capacitor $C_{11}$ from the power source $V_s$.

Further, as shown in FIG. 3B, a conventional falling ramp waveform driving circuit includes a transistor $M_{21}$, a capacitor $C_{21}$, resistors $R_{21}$ and $R_{22}$, a diode $D_{21}$, and a power source for control signals $V_{g2}$; and resistors $R_{23}$ and $R_{24}$ connected between the power source for control signals $V_{g2}$ and the transistor $M_{21}$, and a diode $D_{22}$.

The conventional ramp waveform driving circuit controls current at the drain-source path of transistors $M_{11}$ and $M_{21}$ by the capacitors $C_{11}$ and $C_{21}$, controls on-states of the transistors $M_{11}$ and $M_{21}$, and applies a rising or falling ramp waveform to the panel capacitor $C_p$.

The construction of the conventional falling ramp waveform driving circuit may be the same as that of the rising ramp waveform driving circuit except how the panel capacitor $C_p$ is connected to the transistor $M_{21}$.

The slope of the rising and falling ramp waveforms may precisely control wall charge formation. The conventional rising and falling ramp waveforms may be obtained by changing the slope of the ramp.

However, conventional ramp driving circuits as shown in FIG. 3A and FIG. 3B generate a ramp pulse of a constant slope. Thus, to apply a rising or falling ramp pulse having multiple slopes, independent ramp waveform driving circuits may be needed for each slope.

SUMMARY OF THE INVENTION

The present invention provides a PDP driving apparatus that generates a ramp pulse having multiple slopes.

Additional features of the invention will be set forth in the description which follows, and in part will be apparent from the description, or may be learned by practice of the invention.

The present invention discloses a driving apparatus of a PDP for applying a rising waveform to a panel capacitor. The apparatus comprises a transistor having a drain coupled to a power source, and a source coupled to a first end of the panel capacitor. A first capacitor and a second capacitor are coupled in parallel to each other and in between a drain and a gate of the transistor. A first resistor and a first diode are coupled in parallel to each other between a first end of the first capacitor and the gate or between a second end of the first capacitor and the drain. A second resistor and a second diode are coupled in parallel to each other between a first end of the second capacitor and the gate or between a second end of the second capacitor and the drain.

The present invention also discloses a driving apparatus of a PDP for applying a falling waveform to a panel capacitor. The apparatus comprises a transistor having a source coupled to a power source, and a drain coupled to one end of the panel capacitor. A first capacitor and a second capacitor are coupled in parallel to each other and are coupled between the drain and a gate of the transistor. A first resistor and a first diode are coupled in parallel to each other between a first end of the first capacitor and the gate or between a second end of the first capacitor and the drain. A second resistor and a second diode are coupled in parallel to each other between a first end of the second capacitor and the gate or between a second end of the second capacitor and the drain.

The present invention also discloses a driving apparatus of a PDP for applying a waveform to a panel capacitor comprising a transistor for forming a current path between a power source and the panel capacitor while the transistor is turned on, and which is coupled between the power source and one end of the panel capacitor. A first capacitor is coupled between a drain electrode and a gate electrode of the transistor through a first charge path and a first discharge path. A second capacitor is coupled between a drain electrode and a gate electrode of the transistor through a second charge path and a second discharge path. A charge time of the first capacitor is shorter than a charge time of the second capacitor.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of the specification, illustrate embodiments of the invention and together with the description serve to explain the principles of the invention.

DETAILED DESCRIPTION OF THE ILLUSTRATED EMBODIMENTS

Figure 1:
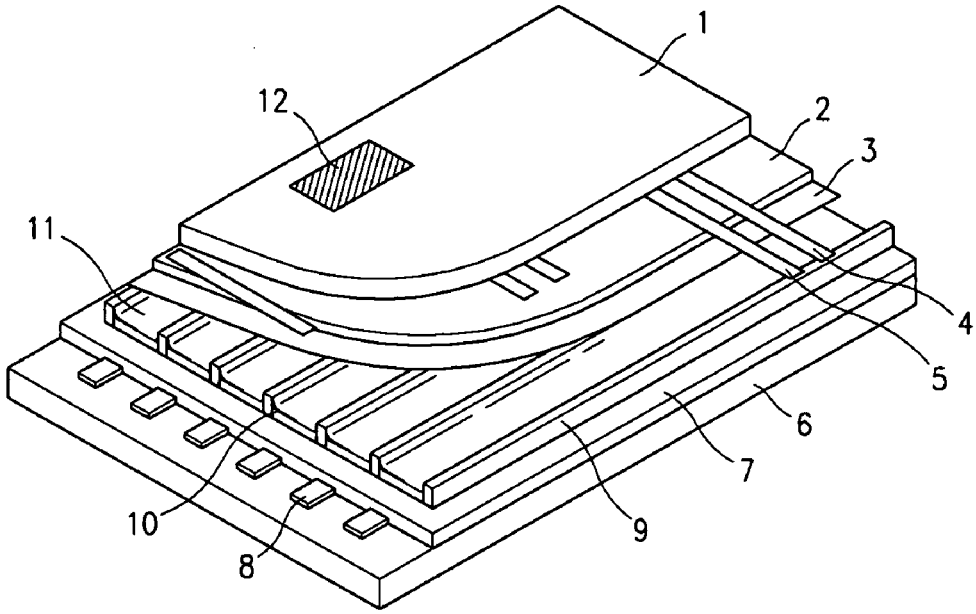
FIG.1(Prior Art)
FIG. 1 is a partial perspective view of a conventional AC PDP.
Figure 2:
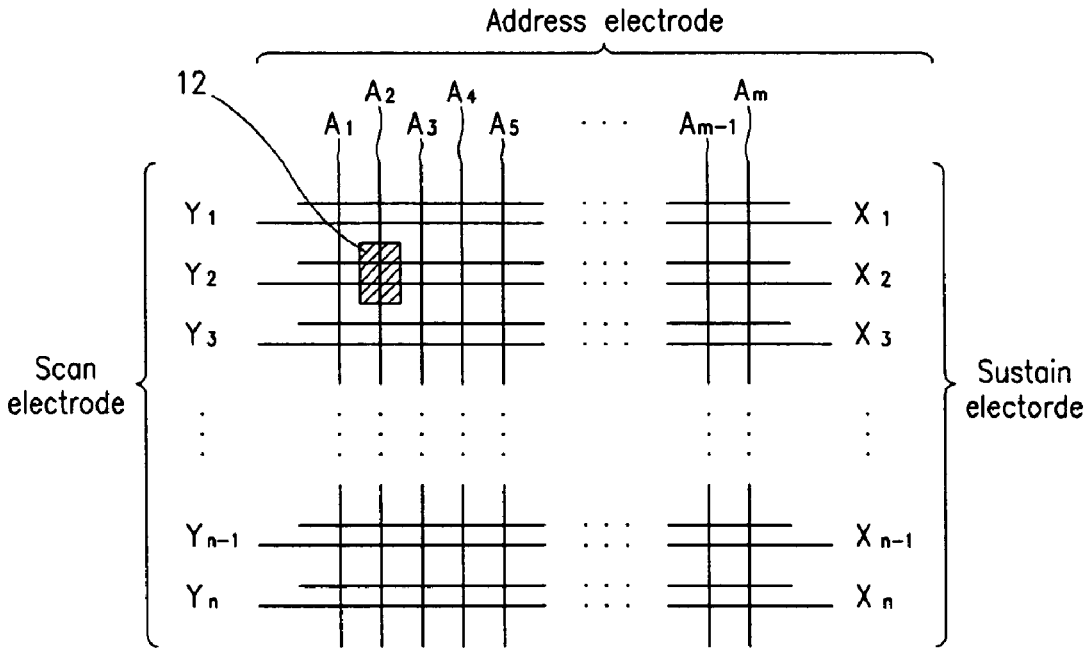
FIG.2(Prior Art)
FIG. 2 shows a typical electrode arrangement of the PDP of FIG. 1.
Figure 3A:
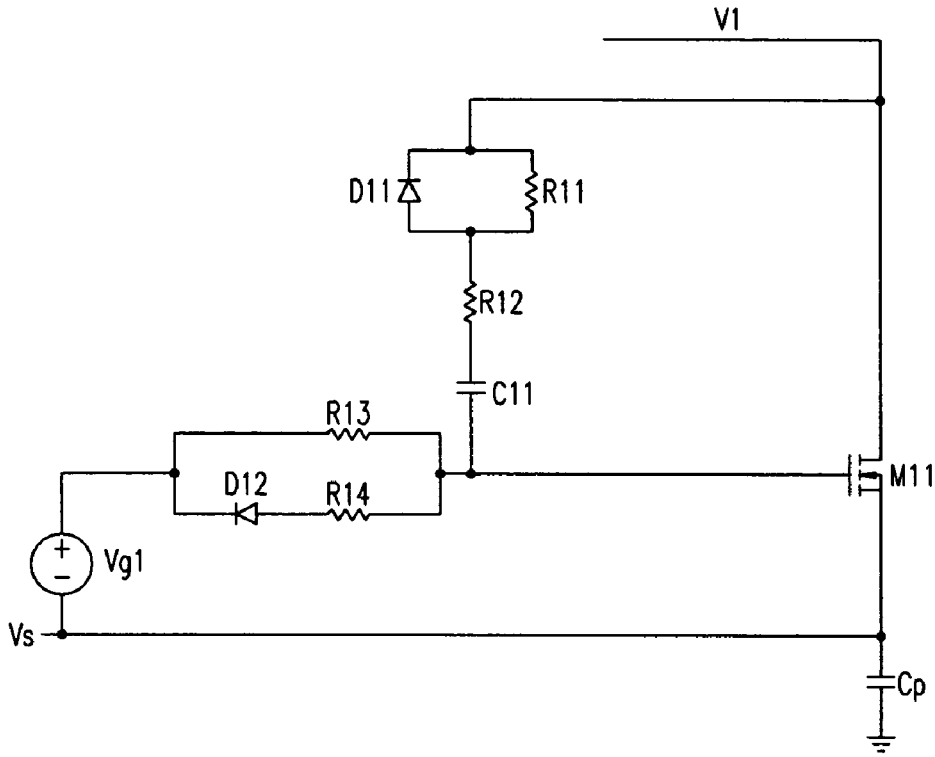
FIG.3A(Prior Art)
FIG. 3A shows a detailed circuit for a conventional rising ramp waveform driver.
Figure 3B:
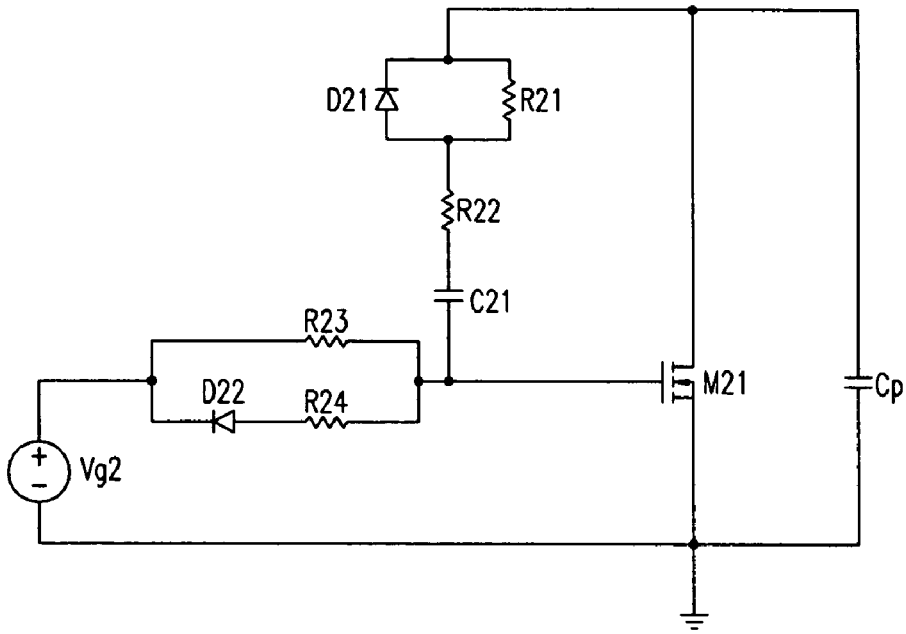
FIG.3B(Prior Art)
FIG. 3B shows a detailed circuit for a conventional falling ramp waveform driver.

The following detailed description shows and describes exemplary embodiments of the invention, simply by way of illustrating best mode contemplated by the inventors of carrying out the invention. As will be realized, the invention can be modified in various obvious respects, all without departing from the invention. Accordingly, the drawings and description are to be regarded as illustrative in nature, and not restrictive. To clarify the present invention, parts which are not described in the specification are omitted, and parts for which similar descriptions are provided have the same reference numerals.

First, a driving method of a PDP according to the first exemplary embodiment is explained in detail with reference to FIG. 4, FIG. 5 and FIG. 6.

Figure 4:
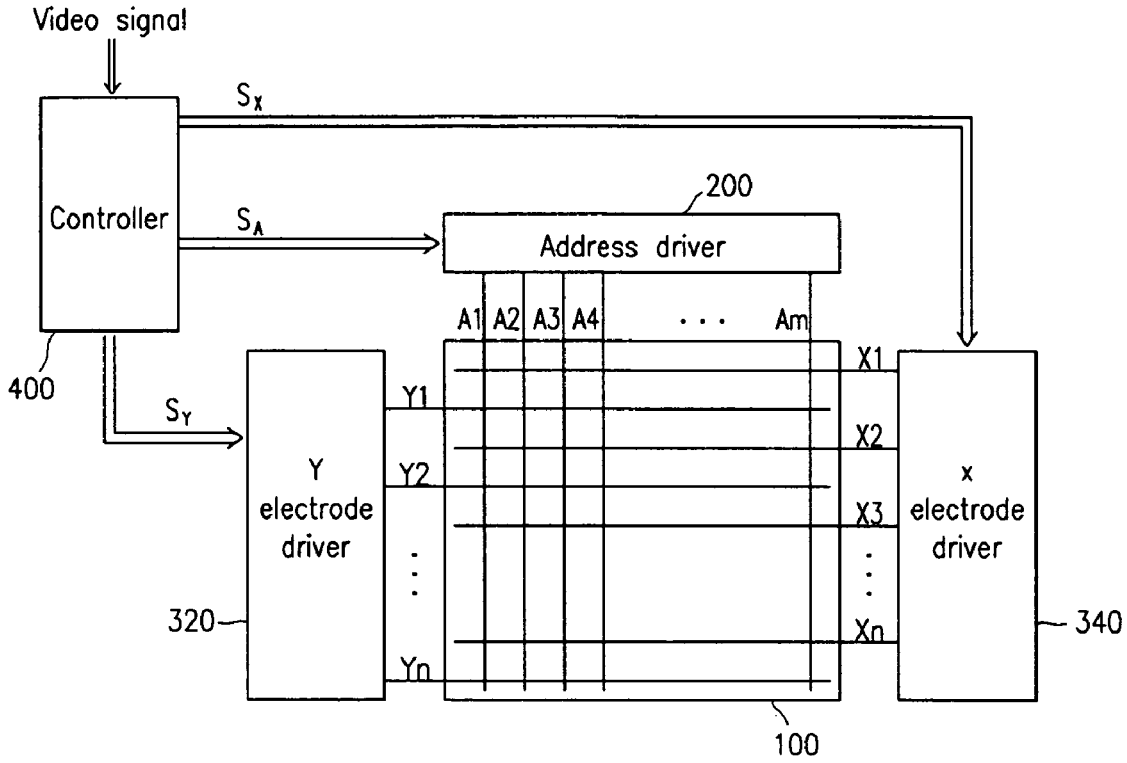
FIG. 4 shows a PDP according to an exemplary embodiment of the present invention.

FIG. 4 shows a PDP according to exemplary embodiments of the present invention.

As shown in FIG. 4, the PDP includes a plasma panel 100, an address driver 200, a Y electrode driver 320, an X electrode driver 340, and a controller 400.

The plasma panel 100 includes a plurality of address electrodes $A_1$ to $A_m$ arranged in the column direction, and a plurality of Y electrodes $Y_1$ to $Y_n$ and a plurality of X electrodes $X_1$ to $X_n$ alternately arranged in the row direction.

The controller 400 receives a video signal and outputs an address driving control signal $S_A$, an X electrode driving signal $S_X$, and a Y electrode driving signal $S_Y$. The controller 400 outputs the address driving control signal $S_A$ to the address driver 200, the X electrode driving signal $S_X$ to the X electrode driver 340, and the Y electrode driving signal $S_Y$ to the Y electrode driver 320.

The address driver 200 receives address driving control signals $S_A$ from the controller 400 and applies display data signals to each address electrode to select desired discharge cells.

The Y electrode driver 320 and the X electrode driver 340 receive the Y electrode driving signals $S_Y$ and the X electrode driving signals $S_X$, respectively, and apply the signals to the Y electrodes and the X electrodes.

Figure 5:
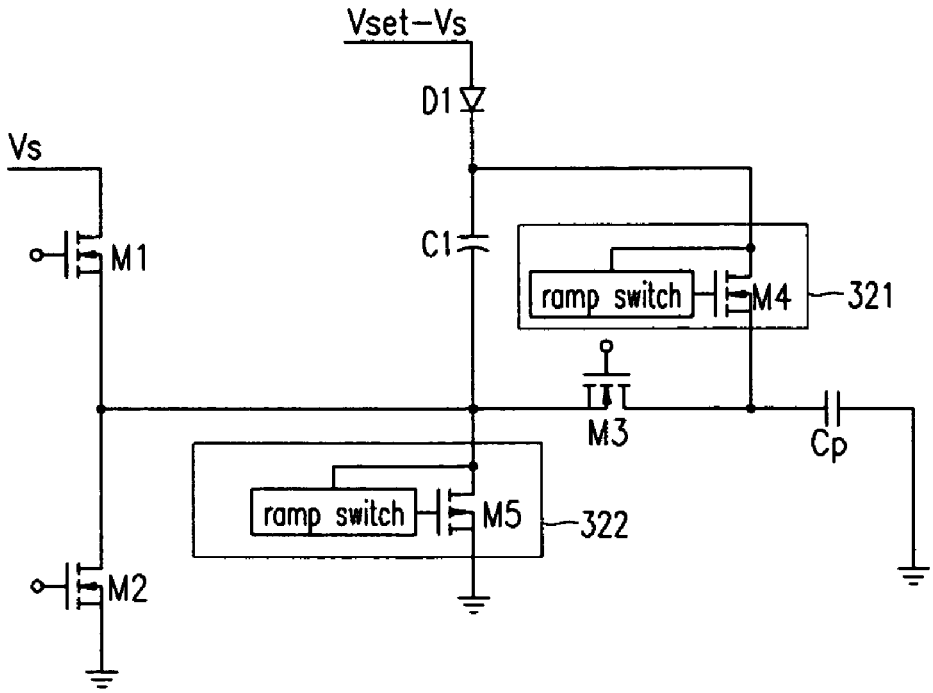
FIG. 5 shows a Y electrode driving circuit of a PDP according to the first exemplary embodiment of the present invention.

FIG. 5 shows a detailed circuit for the Y electrode driver 320 of FIG. 4 according to the first exemplary embodiment.

As shown in FIG. 5, the transistors $M_1$ and $M_2$ are coupled in series between a sustain discharge voltage $V_s$ and a ground voltage, and the transistor $M_3$ is coupled to a node of transistors $M_1$ and $M_2$ and a Y electrode of the panel capacitor $C_p$. The panel capacitor $C_p$ shows an equivalent capacitance component between the X electrode and the Y electrode. For convenience, the X electrode of the panel capacitor $C_p$ is shown and described to be connected to the ground terminal, but it is actually connected to the X electrode driver 340 of FIG. 4.

A first end of the capacitor $C_1$ is coupled to the node between the transistors $M_1$ and $M_2$, and a second end of the capacitor $C_1$ is coupled to the diode $D_1$, which is also coupled to the voltage ($V_{set}$-$V_s$). The rising ramp waveform driver 321, which includes the transistor $M_4$ for applying the rising ramp voltage to the Y electrode of the panel capacitor $C_p$, is coupled between the Y electrode of the panel capacitor $C_p$ and the second end of the capacitor $C_1$. The rising ramp waveform driver 321 further includes a ramp switch comprising a capacitor connected between a drain and a gate of the transistor $M_4$ for supplying a constant current between the source and the drain.

The falling ramp waveform driver 322, which includes the transistor $M_5$ for applying the falling ramp voltage to the Y electrode of the panel capacitor $C_p$, is coupled between the Y electrode of the panel capacitor $C_p$ and the ground voltage. The falling ramp waveform driver 322 further includes a ramp switch comprising a capacitor connected between a drain and a gate of the transistor $M_5$ for supplying a constant current between the source and the drain.

The following explains the rising and falling ramp waveform drivers 321 and 322 according to the first exemplary embodiment of the present invention.

Figure 6A:
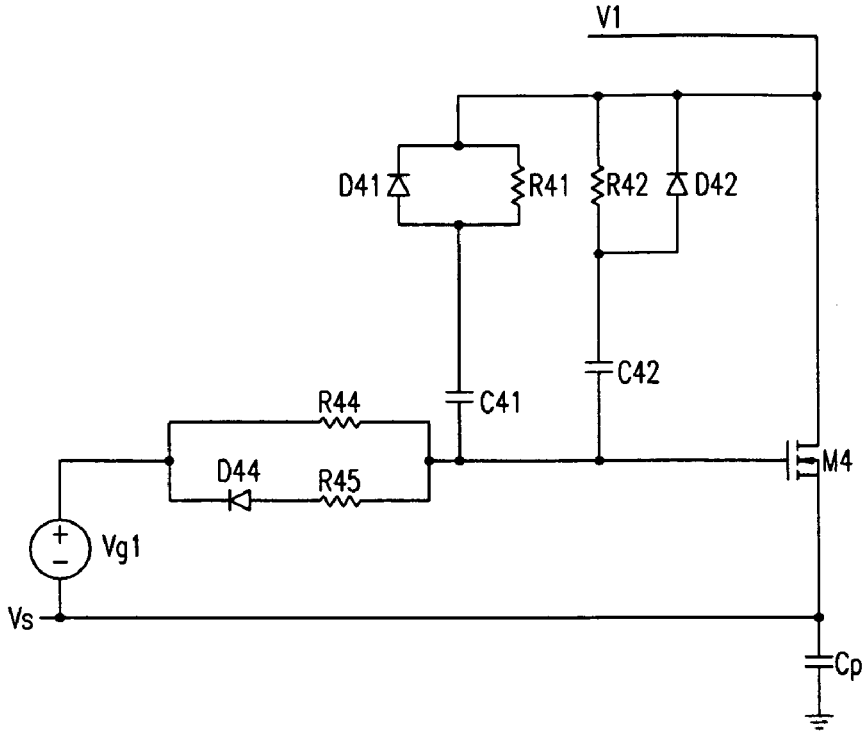
FIG. 6A shows a detailed circuit of the rising ramp waveform driver according to the first exemplary embodiment of the present invention.
Figure 6B:
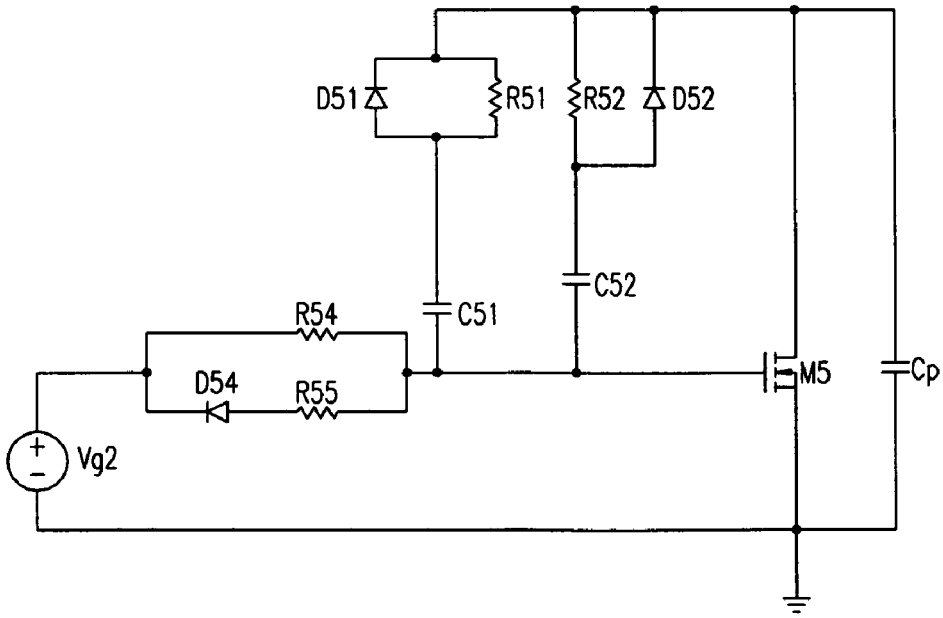
FIG. 6B shows a detailed circuit of the falling ramp waveform driver according to the first exemplary embodiment of the present invention.

FIG. 6A shows a detailed circuit diagram of the rising ramp waveform driver 321 and FIG. 6B shows a detailed circuit diagram of the falling ramp waveform driver 322 according to the first exemplary embodiment.

In the rising ramp waveform driver 321 and the falling ramp waveform driver 322 according to the first exemplary embodiment, a plurality of capacitors are coupled between the drain and the gate of the transistors $M_4$ and $M_5$, which apply the ramp waveforms to the Y electrode of the panel capacitor $C_p$. The rising ramp waveform driver 321 and the falling ramp waveform driver 322 generate a ramp pulse having two slopes.

Referring to FIG. 6A, two capacitors $C_{41}$ and $C_{42}$ are coupled in parallel between the drain and the gate of the transistor $M_4$. A resistor and a diode ($R_{41}$-$D_{41}$), and a second resistor and a second diode ($R_{42}$-$D_{42}$), are coupled in parallel to the capacitors $C_{41}$ and $C_{42}$, respectively. The resistors and diodes ($R_{41}$-$D_{41}$, $R_{42}$-$D_{42}$) form a charge path and a discharge path. Different voltage charge times of the capacitors $C_{41}$ and $C_{42}$ may be obtained by providing the capacitors $C_{41}$ and $C_{42}$ with different capacitances, or by providing the resistors $R_{41}$ and $R_{42}$ with different resistances, or by controlling the RC time constant by changing the value of the capacitors and the resistors.

Similarly, as shown in FIG. 6B, two capacitors $C_{51}$ and $C_{52}$ are coupled in parallel between the drain and the gate of the transistor $M_5$ in the falling ramp waveform driver 322 according to the first exemplary embodiment. A resistor and a diode ($R_{51}$-$D_{51}$), and a second resistor and a second diode ($R_{52}$-$D_{52}$), are connected in parallel to each capacitor $C_{51}$ and $C_{52}$, respectively. The resistors and diodes ($R_{51}$-$D_{51}$, $R_{52}$-$D_{52}$) form the charge path and the discharge path. Different voltage charge times of the capacitors $C_{51}$ and $C_{52}$ may be obtained by providing the capacitors $C_{51}$ and $C_{52}$ with different capacitances, or by providing the resistors $R_{51}$ and $R_{52}$ with different resistances, or by controlling the RC time constant by changing the value of the capacitors and the resistors.

Next, the operation of the ramp driving circuits according to the first exemplary embodiment is explained in more detail.

First, the operation of the rising ramp waveform driver 321 according to the first exemplary embodiment is explained with reference to FIG. 5, FIG. 6A, and FIG. 7A.

Figure 7A:
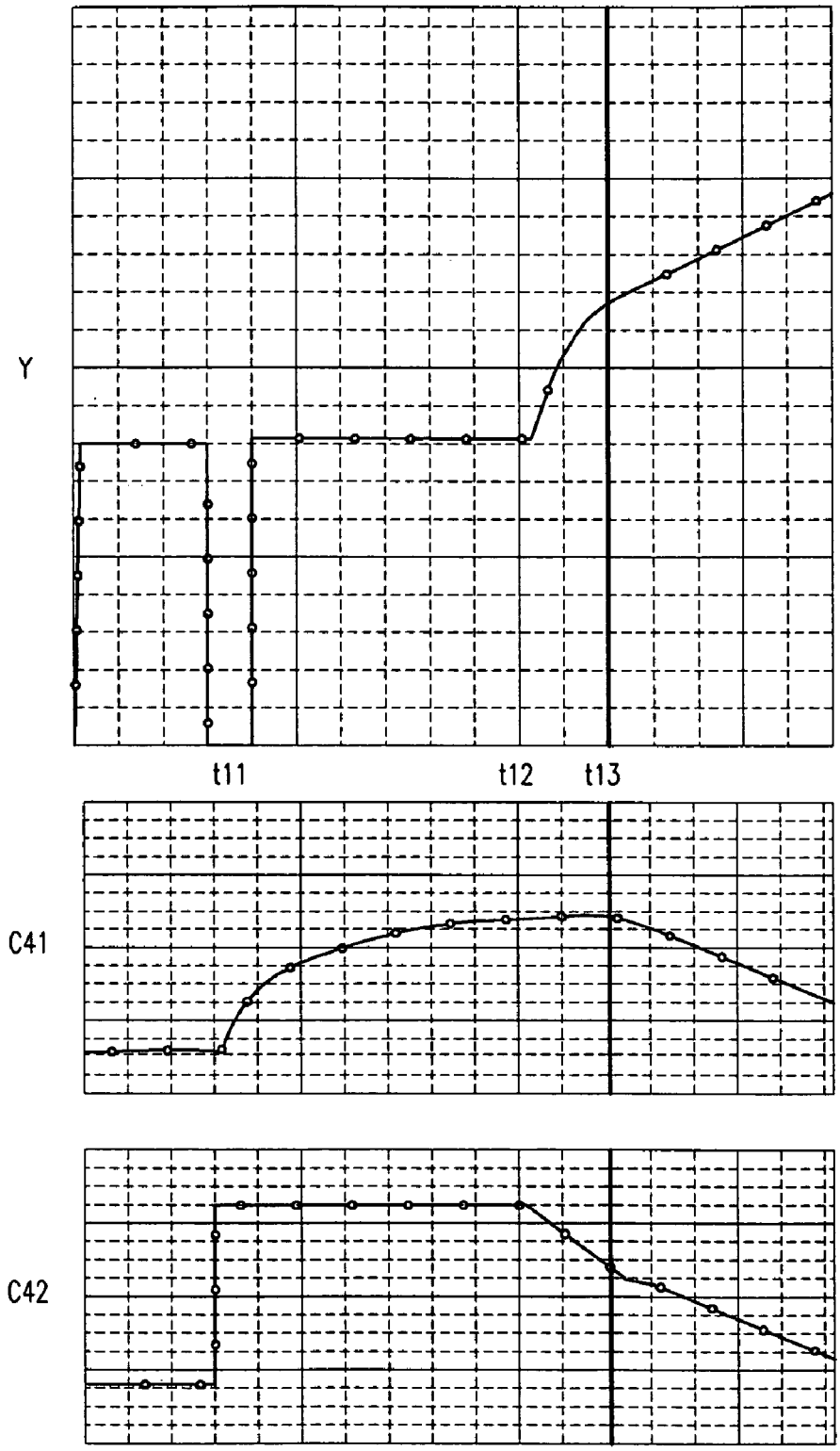
FIG. 7A shows waveforms for voltage of a Y electrode and voltages of capacitors in the rising ramp waveform driver according to the first exemplary embodiment of the present invention.

FIG. 7A shows waveforms for voltage of a Y electrode of the panel capacitor $C_p$ and voltages of the capacitors $C_{41}$ and $C_{42}$ in the rising ramp waveform driver 321 according to the first exemplary embodiment.

At time $t_{11}$, transistors $M_1$ and $M_3$ are turned on and a voltage $V_s$ is supplied to the Y electrode of the panel capacitor $C_p$. Then, the potential of a power source $V_1$ becomes $V_{set}$ by the capacitor $C_1$, which is charged with the voltage $V_{set}$-$V_s$. Thus, the $V_{set}$ potential starts charging the capacitors $C_{41}$ and $C_{42}$. The charge speed depends on the RC time constant defined by the capacitors $C_{41}$ and $C_{42}$ and the resistors $R_{41}$ and $R_{42}$.

At time $t_{12}$, the transistor $M_3$ turns off, and the power source $V_{g1}$ applies control signals to the gate of the transistor $M_4$ to turn on the transistor $M_4$. Then, the voltage $V_{set}$ of the second end of the capacitor $C_1$ is supplied to the Y electrode of the panel capacitor $C_p$ through the transistor $M_4$, and the Y electrode voltage of the panel capacitor $C_p$ increases.

If $C_{41}$=1.5 nF, $R_{41}$=2 kΩ, $C_{42}$=1.5 nF, and $R_{42}$=100Ω, the time constant determined by the capacitor $C_{42}$ and the resistor $R_{42}$ is smaller than the time constant determined by the capacitor $C_{41}$ and the resistor $R_{41}$. Hence, the charge time for the capacitor $C_{42}$ is shorter than the charge time for the capacitor $C_{41}$. Thus, the capacitor $C_{42}$ almost completes charging at time $t_{11}$, which is when the transistors $M_1$ and $M_3$ are turned on, while the charge of the capacitor $C_{41}$ is not completed at time $t_{12}$.

Therefore, when the transistor $M_4$ turns on at time $t_{12}$, the voltage charged in the capacitor $C_{42}$ is higher than that of the panel capacitor $C_p$. Thus, the voltage charged in the capacitor $C_{42}$ may be discharged to the Y electrode of the panel capacitor $C_p$ through the diode $D_{42}$-transistor $M_4$ path. Additionally, a current supplied to the gate of the transistor $M_4$ through the power source $V_{g1}$ flows out along the capacitor $C_{42}$-diode $D_{42}$ path.

Thus, the voltage of the transistor $M_4$ may be constantly maintained at a substantially low voltage state, and a small amount of current flows to the transistor $M_4$. Consequently, the voltage at the Y electrode of the panel capacitor $C_p$ gradually increases, and the voltage of the capacitor $C_{42}$ decreases. At this time, the voltage is still charged to the capacitor $C_{41}$, since the voltage of the capacitor $C_{41}$ is less than the Y electrode voltage of the panel capacitor $C_p$.

The capacitor $C_{42}$ continues to discharge and the capacitor $C_{41}$ continues to charge until the voltage of both capacitors becomes equal at time $t_{13}$. At that point, in addition to the voltage from the capacitor $C_{42}$, the voltage charged in the capacitor $C_{41}$ starts to discharge to the Y electrode of the panel capacitor $C_p$ through the diode $D_{41}$-transistor $M_4$ path.

Further, the current supplied to the gate of the transistor $M_4$ through the power source $V_{g1}$ flows out through the capacitor $C_{42}$-diode $D_{42}$ path and the capacitor $C_{41}$-diode $D_{41}$ path. Thus, the current supplied to the gate of the transistor $M_4$ decreases, the voltage $V_{gs}$ between the gate and the source of the transistor $M_4$ decreases, and the current between the drain-source of the transistor $M_4$ decreases. Therefore, as shown in FIG. 7A, the slope of the voltage charged to the Y electrode of the panel capacitor $C_p$ becomes less steep. As such, a rising ramp waveform having two slopes may be applied to the Y electrode of the panel capacitor $C_p$.

Figure 7B:
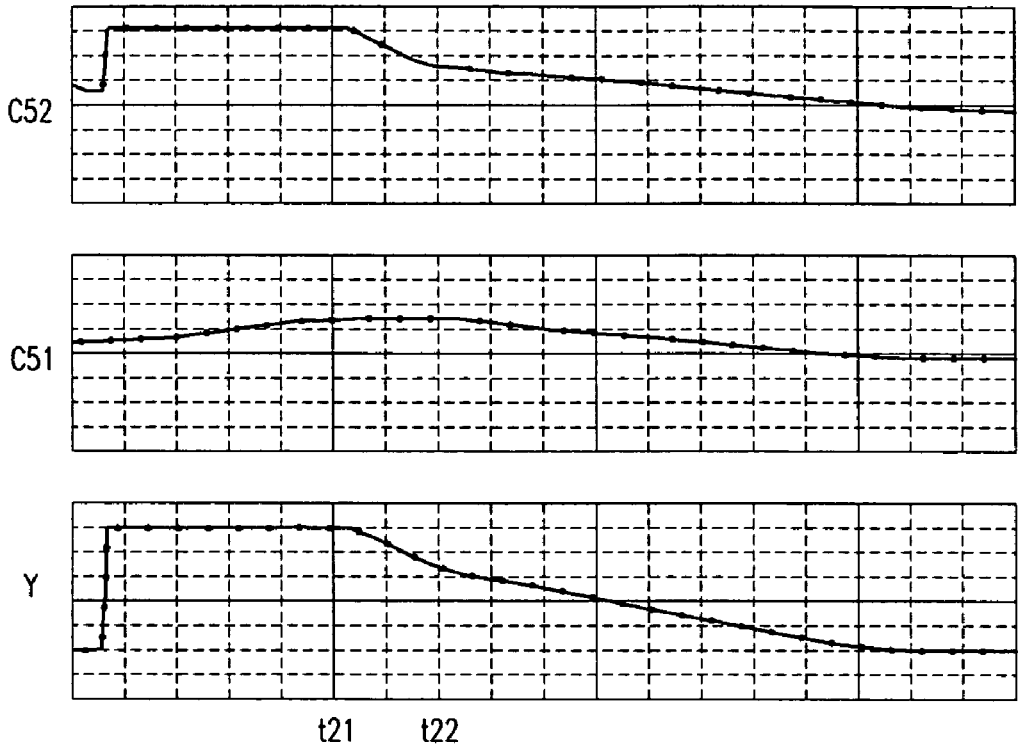
FIG. 7B shows waveforms for voltage of a Y electrode and voltages of capacitors in the falling ramp waveform driver according to the first exemplary embodiment of the present invention.

The following explains the operation of the falling ramp waveform driver 322 according to the first exemplary embodiment with reference to FIG. 5, FIG. 6B, and FIG. 7B.

FIG. 7B shows waveforms for voltage of the Y electrode and voltages of the capacitors C51 and C52 in the falling ramp waveform driver 322 according to the first exemplary embodiment.

While the rising ramp is applied to the Y electrode of the panel capacitor $C_p$ (while the transistor $M_1$ is on), the power source $V_s$ charges the capacitors $C_{51}$ and $C_{52}$. Charge time of the capacitors $C_{51}$ and $C_{52}$ may be determined by the values of the capacitors $C_{51}$ and $C_{52}$ and resistors $R_{51}$ and $R_{52}$.

At time $t_{21}$, with the transistor $M_3$ on and transistor $M_4$ off, the transistor $M_1$ turns off, and the power source $V_{g2}$ applies control signals to the gate electrode of the transistor $M_5$ for turning on the transistor $M_5$. Then, voltage charged in the panel capacitor $C_p$ discharges to the transistor $M_5$, and the Y electrode voltage of the panel capacitor $C_p$ starts to fall.

If $C_{51}$=1.5 nF, $R_{51}$=2 kΩ, $C_{52}$=1.5 nF, and $R_{52}$=100Ω, the charge time for the capacitor C52 is shorter than the charge time for the capacitor $C_{51}$. Thus, the capacitor $C_{52}$ may complete charging at almost the same time that the transistors $M_1$ and $M_3$ are turned on in the rising ramp period, since the size of the resistor $R_{52}$ is small. The charge of the capacitor $C_{51}$ may not be completed at that time.

Therefore, when the transistor $M_5$ turns on at time $t_{21}$, the voltage charged in the capacitor $C_{52}$ exceeds that of the panel capacitor $C_p$. Thus, the voltage charged in the capacitor $C_{52}$ discharges to the Y electrode of the panel capacitor $C_p$ through the diode $D_{52}$. Additionally, the current supplied to the gate of the transistor $M_5$ through power source $V_{g2}$ also flows out along the capacitor $C_{52}$-diode $D_{52}$ path.

Thus, the voltage of the transistor $M_5$ may be constantly maintained at a low voltage, and a small amount of current flows through the transistor $M_5$. Thus, as shown in FIG. 7B, the Y electrode voltage of the panel capacitor $C_p$ gradually decreases, and the voltage of the capacitor $C_{52}$ also decreases. At this time, the capacitor $C_{51}$ continues to be charged since the voltage of the capacitor $C_{52}$ is less than the Y electrode voltage of the panel capacitor $C_p$.

The panel capacitor $C_p$ and the capacitor $C_{52}$ continue to discharge while the capacitor $C_{51}$ continues to be charged until the voltages of the capacitors $C_{51}$ and $C_{52}$ and the voltage of the Y electrode of the panel capacitor $C_p$ become the same at time $t_{22}$. At this point, in addition to the discharge from the capacitor $C_{52}$, the voltage charged in the capacitor $C_{51}$ also starts to discharge to the Y electrode of the panel capacitor $C_p$ through the diode $D_{51}$ path.

Further, the current supplied to the gate of the transistor $M_5$ through the power source $V_{g2}$ flows out through the capacitor $C_{52}$-diode $D_{52}$ path and the capacitor $C_{51}$-diode $D_{51}$ path. Thus, the current supplied to the gate of the transistor $M_5$ decreases, the voltage $V_{gs}$ between the gate-source of the transistor $M_5$ decreases, and the current between the drain-source of the transistor $M_5$ decreases. Therefore, as shown in FIG. 7B, the slope of the voltage discharged from the panel capacitor $C_p$ becomes less steep. As such, the falling ramp waveform having two slopes may be applied to the Y electrode of the panel capacitor $C_p$.

The first exemplary embodiment discloses that the capacitor may be connected to the gate of the transistor, and the diode and the resistor are connected in parallel to the drain of the transistor. However, the rising ramp waveform driver and the falling ramp waveform driver circuits may be changed so that the diode and the resistor are connected in parallel to the gate of the transistor and the capacitor is connected to the drain of the transistor.

Further, the discharge speed of a capacitor may be controlled by inserting a resistor(s) (not shown) in the path in which a capacitor is discharged.

While the first exemplary embodiment of the present invention discloses rising and falling driving circuits having two slopes, circuits for generating ramp waveforms having at least 3 slopes may be embodied by adding the desired number of capacitor, resistor, and diode circuits between the gate and the drain of the transistor that applies the ramp waveform to the panel capacitor.

Figure 8A:
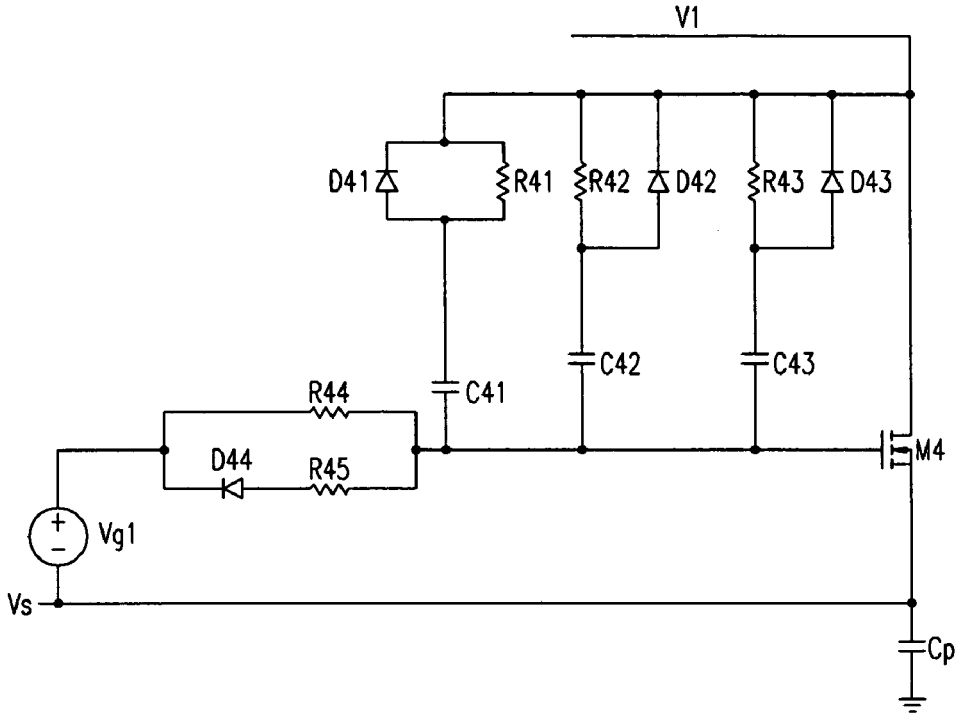
FIG. 8A shows a circuit of the rising ramp waveform driver according to the second exemplary embodiment of the present invention.
Figure 8B:
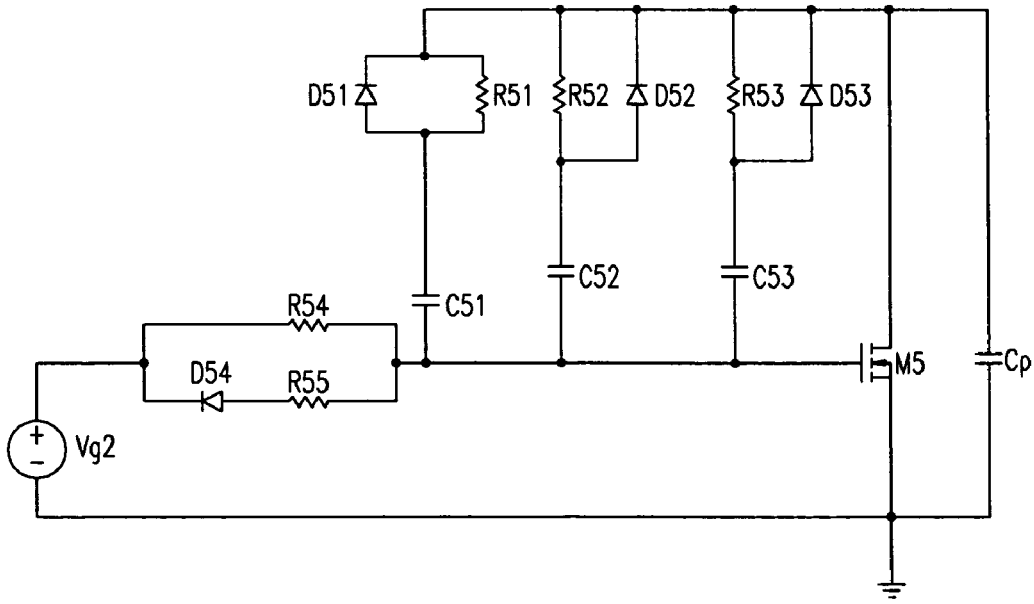
FIG. 8B shows a circuit of the falling ramp waveform driver according to the second exemplary embodiment of the present invention.

FIG. 8A and FIG. 8B show ramp driving circuits providing ramp pulses having 3 slopes according to the second exemplary embodiment of the present invention. FIG. 8A shows a rising ramp driving circuit, and FIG. 8B shows a falling ramp driving circuit.

As shown in FIG. 8A, the rising ramp driving circuit according to the second exemplary embodiment further comprise a capacitor $C_{43}$, a resistor $R_{43}$, and a diode $D_{43}$ between the gate and the drain of the transistor $M_4$ added to the circuit shown in FIG. 6A. The rising ramp driving circuit can generate a rising waveform having 3 slopes.

Similarly, as shown in FIG. 8B, the falling ramp driving circuit according to the second exemplary embodiment further comprises a capacitor $C_{53}$, a resistor $R_{53}$ and a diode $D_{53}$ between the gate and the drain of the transistor $M_5$ of the circuit of FIG. 6B. The falling ramp driving circuit can generate a falling waveform having 3 slopes.

As mentioned above, the charge time of the capacitors may be determined by the capacitance of the capacitor, and the resistance of the resistor connected to the capacitor, in the ramp driving circuits according to the first and second exemplary embodiments. However, the voltage charged in the capacitor may be controlled by using a Zener diode.

Figure 9A:
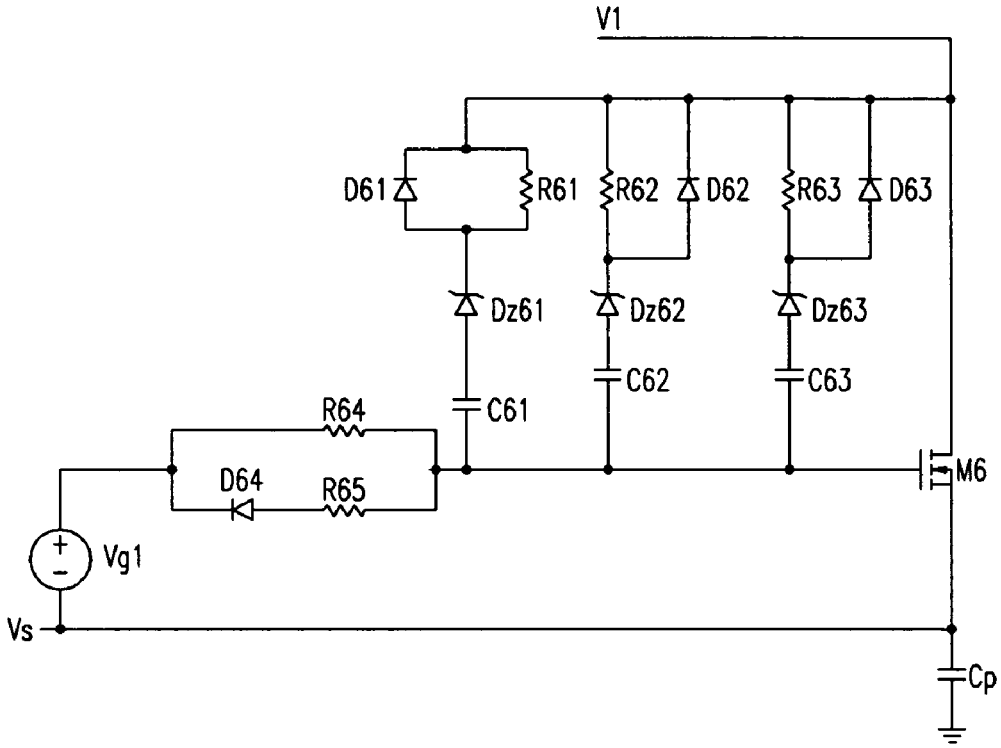
FIG. 9A shows a circuit of the rising ramp waveform driver according to the third exemplary embodiment of the present invention.
Figure 9B:
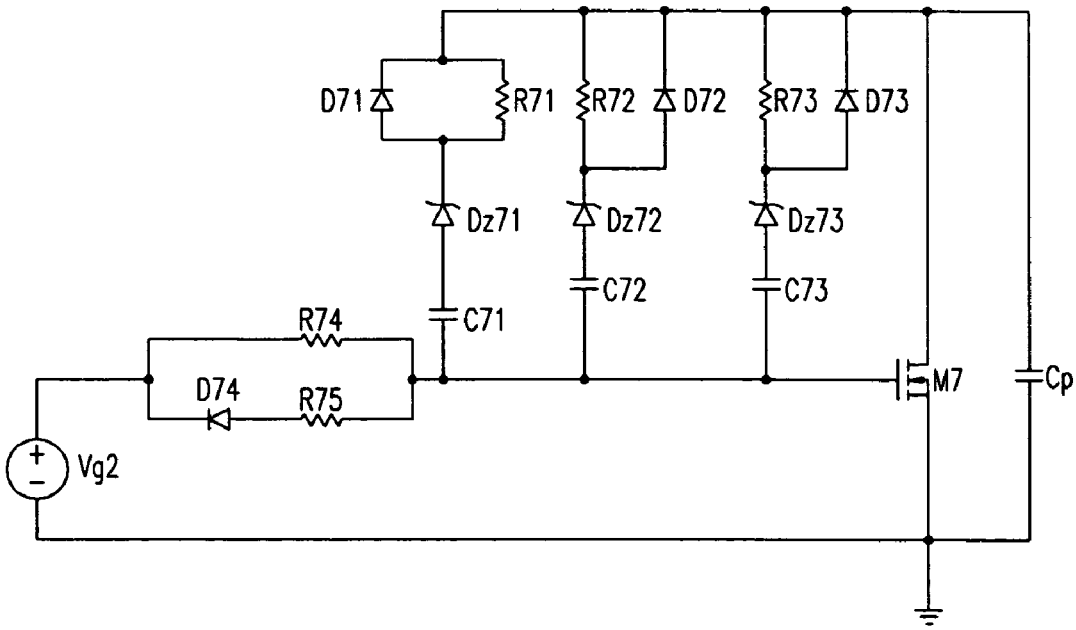
FIG. 9B shows a circuit of the falling ramp waveform driver according to the third exemplary embodiment of the present invention.

FIGS. 9A and 9B show ramp driving circuits having 3 slopes according to the third exemplary embodiment of the present invention. FIG. 9A shows a rising ramp driving circuit, and FIG. 9B shows a falling ramp driving circuit.

As shown in FIG. 9A, the rising ramp driving circuit according to the third exemplary embodiment comprises Zener diodes added between each capacitor and each parallel connection of the diode and the resistor ($D_{61}$-$R_{61}$, $D_{62}$-$R_{62}$, and $D_{63}$-$R_{63}$) in the circuit of FIG. 8A. Each Zener diode may have a different breakdown voltage $V_z$.

Voltages as large as the breakdown voltage $V_z$ may be applied to each Zener diode ($D_{Z61}$, $D_{Z62}$, and $D_{Z63}$) when each capacitor ($C_{61}$, $C_{62}$, and $C_{63}$) is charged through each resistor ($R_{61}$, $R_{62}$, and $R_{63}$). Thus, differences between voltage $V_1$ and the breakdown voltage $V_z$ of the Zener diodes ($D_{Z61}$, $D_{Z62}$, and $D_{Z63}$) may be charged in the capacitors ($C_{61}$, $C_{62}$, and $C_{63}$), which are coupled to each Zener diode.

When the transistor $M_6$ turns on, each capacitor ($C_{61}$, $C_{62}$, and $C_{63}$) discharges in order according to the amount of voltage it is charged with. The Zener diodes do not affect the discharge path of the capacitor because with an inverse direction of current flow, the Zener diodes ($D_{Z61}$, $D_{Z62}$, and $D_{Z63}$) work as general diodes.

Similarly, as shown in FIG. 9B, the falling ramp driving circuit according to the third exemplary embodiment comprises added Zener diodes ($D_{Z71}$, $D_{Z72}$, and $D_{Z73}$) between each capacitor ($C_{71}$, $C_{72}$, and $C_{73}$) and each parallel connection of the diode and the resistor ($D_{71}$-$R_{71}$, $D_{72}$-$R_{72}$, $D_{73}$-$R_{73}$) in the circuit of FIG. 8B.

Voltages as large as the breakdown voltage $V_z$ may be applied to each Zener diode ($D_{Z71}$, $D_{Z72}$, and $D_{Z73}$) when each of the capacitors ($C_{71}$, $C_{72}$, and $C_{73}$) is charged through each of the resistors ($R_{71}$, $R_{72}$, and $R_{73}$). Thus, differences between the Y electrode voltage of the panel capacitor $C_p$ and the breakdown voltage $V_z$ of the Zener diodes ($D_{Z71}$, $D_{Z72}$, and $D_{Z73}$) may be charged in the capacitors ($C_{71}$, $C_{72}$, and $C_{73}$), which are coupled to the Zener diodes.

When the transistor $M_7$ turns on, each of the capacitors ($C_{71}$, $C_{72}$, and $C_{73}$) starts to discharge in order according to the amount of voltage charged in each capacitor. The Zener diodes do not affect the discharge path of the capacitors because with an inverse direction of current flow, the Zener diodes ($D_{Z71}$, $D_{Z72}$, and $D_{Z73}$) work as general diodes.

Further, the Y electrode voltage of the panel capacitor $C_p$ may be instantaneously reduced to the voltage charged in the capacitor that starts to discharge first. The slope of the discharged voltage may then decrease each time discharge of a capacitor occurs, in order.

Figure 10A:
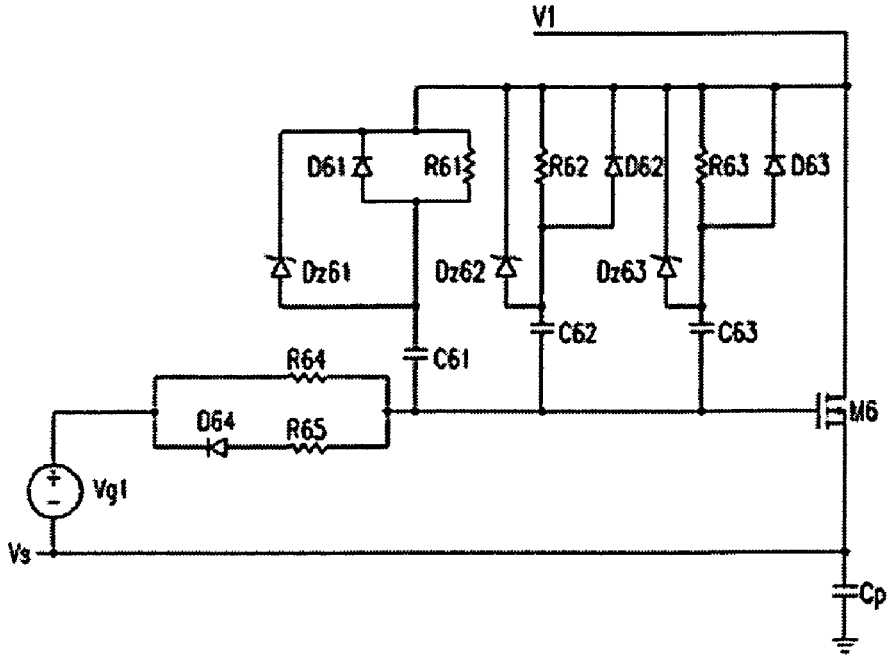
FIG. 10A shows a circuit of the rising ramp waveform driver according to a modification of the third exemplary embodiment of the present invention.
Figure 10B:
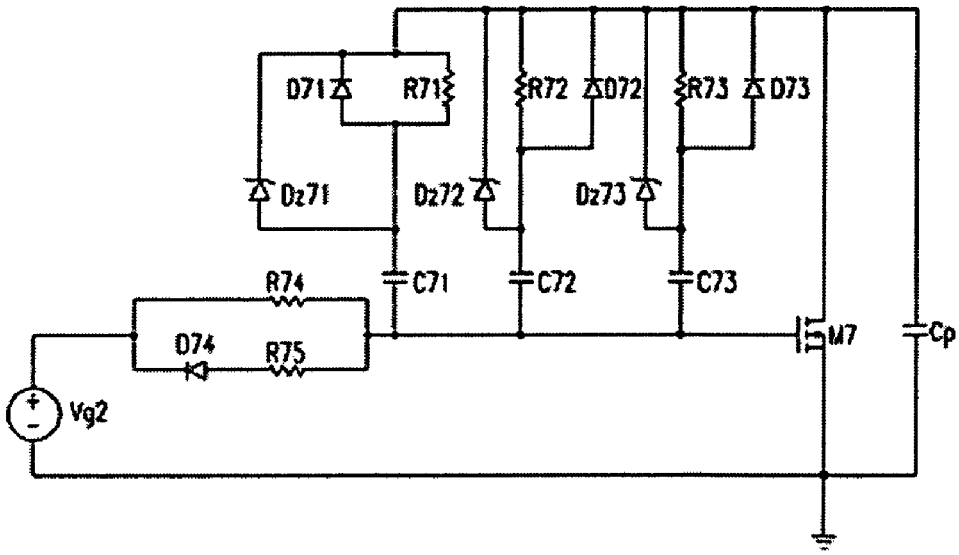
FIG. 10B shows a circuit of the falling ramp waveform driver according to a modification of the third exemplary embodiment of the present invention.

As shown in FIG. 9A and FIG. 9B, the Zener diode is connected in series to the path for charging the capacitor. However, as shown in FIG. 10A and FIG. 10B, the Zener diode may also be coupled in parallel to the path for charging the capacitor. Additionally, while FIG. 9A and FIG. 9B show Zener diodes added to the rising and falling ramp waveform driver circuits of FIG. 8A and FIG. 8B, Zener diodes may also be similarly added to the rising and falling ramp waveform driver circuits of FIG. 6A and FIG. 6B.

Generally, when an image frame is time divided into a plurality of subfields, the rising ramp pulse may be followed by the falling ramp pulse in the reset period of the first subfield, and only the falling ramp pulse may be applied in the reset periods of the subsequent subfields. The first, second, and third exemplary embodiments disclose that the rising ramp and falling ramp pulse may be applied in the reset period of the first sub-field. However, the present invention may be utilized to apply the falling ramp pulse in the reset period of the subfields following the first subfield.

As mentioned above, the present invention generates ramp pulses having multi-slopes by using one driving circuit, which may allow precision control of wall charges in the reset period.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A driving apparatus of a plasma display panel for applying a rising waveform to a panel capacitor, comprising:

a transistor having a drain coupled to a power source, and a source coupled to a first end of the panel capacitor;

a first capacitor coupled between the drain and a gate of the transistor;

a second capacitor coupled between the drain and the gate of the transistor, and coupled in parallel with the first capacitor;

a first resistor and a first diode coupled in parallel to each other between a first end of the first capacitor and the gate or between a second end of the first capacitor and the drain;

a second resistor and a second diode coupled in parallel to each other between a first end of the second capacitor and the gate or between a second end of the second capacitor and the drain;

a first Zener diode coupled in a path in which the first capacitor is charged; and a second Zener diode coupled in a path in which the second capacitor is charged.

2. The apparatus of claim 1, wherein the first capacitor is charged through the first resistor and the second capacitor is charged through the second resistor; and wherein a charge time of the first capacitor is shorter than a charge time of the second capacitor.

3. The apparatus of claim 2, wherein a resistance of the first resistor is less than a resistance of the second resistor.

4. The apparatus of claim 2, wherein a capacitance of the first capacitor is less than a capacitance of the second capacitor.

5. The apparatus of claim 1, wherein a breakdown voltage of the first Zener diode is different from a breakdown voltage of the second Zener diode.

6. A driving apparatus of a plasma display panel for applying a rising waveform to a panel capacitor, comprising:

a transistor having a drain coupled to a power source, and a source coupled to a first end of the panel capacitor;

a first capacitor coupled between the drain and a gate of the transistor;

a second capacitor coupled between the drain and the gate of the transistor, and coupled in parallel with the first capacitor;

a first resistor and a first diode coupled in parallel to each other between a first end of the first capacitor and the gate or between a second end of the first capacitor and the drain;

a second resistor and a second diode coupled in parallel to each other between a first end of the second capacitor and the gate or between a second end of the second capacitor and the drain;

a first Zener diode coupled in parallel to the first resistor; and a second Zener diode coupled in parallel to the second resistor.

7. The apparatus of claim 6, wherein a breakdown voltage of the first Zener diode is different from a breakdown voltage of the second Zener diode.

8. The apparatus of claim 1, wherein the panel capacitor is charged from the power source while the transistor is turned on.

9. A driving apparatus of a plasma display panel for applying a falling waveform to a panel capacitor, comprising:

a transistor having a source coupled to a power source, and a drain coupled to one end of the panel capacitor;

a first capacitor coupled between the drain and a gate of the transistor;

a second capacitor coupled between the drain and the gate of the transistor, and coupled in parallel with the first capacitor;

a first resistor and a first diode coupled in parallel to each other between a first end of the first capacitor and the gate or between a second end of the first capacitor and the drain;

a second resistor and a second diode coupled in parallel to each other between a first end of the second capacitor and the gate or between a second end of the second capacitor and the drain;

a first Zener diode coupled in a path in which the first capacitor is charged; and a second Zener diode coupled in a path in which the second capacitor is charged, wherein a breakdown voltage of the first Zener diode is different from a breakdown voltage of the second Zener diode.

10. The apparatus of claim 9, wherein the first capacitor is charged through the first resistor and the second capacitor is charged through the second resistor; and wherein a charge time of the first capacitor is shorter than a charge time of the second capacitor.

11. The apparatus of claim 10, wherein a resistance of the first resistor is less than a resistance of the second resistor.

12. The apparatus of claim 10, wherein a capacitance of the first capacitor is less than a capacitance of the second capacitor.

13. A driving apparatus of a plasma display panel for applying a falling waveform to a panel capacitor, comprising:

a transistor having a source coupled to a power source, and a drain coupled to one end of the panel capacitor;

a first capacitor coupled between the drain and a gate of the transistor;

a second capacitor coupled between the drain and the gate of the transistor, and coupled in parallel with the first capacitor;

a first resistor and a first diode coupled in parallel to each other between a first end of the first capacitor and the gate or between a second end of the first capacitor and the drain;

a second resistor and a second diode coupled in parallel to each other between a first end of the second capacitor and the gate or between a second end of the second capacitor and the drain;

a first Zener diode coupled in parallel to the first resistor; and a second Zener diode coupled in parallel to the second resistor.

14. The apparatus of claim 13, wherein a breakdown voltage of the first Zener diode is different from a breakdown voltage of the second Zener diode.

15. The apparatus of claim 9, wherein the panel capacitor is discharged to the power source while the transistor is turned on.

16. A driving apparatus of a plasma display panel for applying a waveform to a panel capacitor, comprising:

a transistor for forming a current path between a power source and the panel capacitor while the transistor is turned on, and which is coupled between the power source and one end of the panel capacitor;

a first capacitor coupled between a drain electrode and a gate electrode of the transistor through a first charge path and a first discharge path;

a second capacitor coupled between the drain electrode and the gate electrode of the transistor through a second charge path and a second discharge path;

a first Zener diode coupled in the first charge path; and a second Zener diode coupled in the second charge path, wherein a charge time of the first capacitor is shorter than a charge time of the second capacitor.

17. The driving apparatus of claim 16, wherein the first charge path includes a first resistor and the second charge path includes a second resistor; and wherein a resistance of the first resistor is less than a resistance of the second resistor.

18. The apparatus of claim 16, wherein a capacitance of the first capacitor is less than a capacitance of the second capacitor.

19. The apparatus of claim 16, wherein a breakdown voltage of the first Zener diode is different from a breakdown voltage of the second Zener diode.

20. A driving apparatus of a plasma display panel for applying a waveform to a panel capacitor, comprising:

a transistor for forming a current path between a power source and the panel capacitor while the transistor is turned on, and which is coupled between the power source and one end of the panel capacitor;

a first capacitor coupled between a drain electrode and a gate electrode of the transistor through a first charge path and a first discharge path;

a second capacitor coupled between the drain electrode and the gate electrode of the transistor through a second charge path and a second discharge path;

a first Zener diode coupled in parallel to the first charge path; and a second Zener diode coupled in parallel to the second charge path, wherein a charge time of the first capacitor is shorter than a charge time of the second capacitor.

21. The apparatus of claim 20, wherein a breakdown voltage of the first Zener diode is different from a breakdown voltage of the second Zener diode.

22. The apparatus of claim 16, wherein a rising waveform is applied to the panel capacitor while the transistor is turned on.

23. The apparatus of claim 16, wherein a falling waveform is applied to the panel capacitor while the transistor is turned on.

* * * * *

UNITED STATES PATENT AND TRADEMARK OFFICE

CERTIFICATE OF CORRECTION

PATENT NO. : 7,652,641 B2
APPLICATION NO. : 10/968162
DATED : January 26, 2010
INVENTOR(S) : Chae et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1307 days.

Signed and Sealed this

Twenty-third Day of November, 2010

David J. Kappos

David J. Kappos
*Director of the United States Patent and Trademark Office*